US010745831B2

(12) United States Patent
Aydin et al.

(10) Patent No.: US 10,745,831 B2
(45) Date of Patent: Aug. 18, 2020

(54) AIR-JET FANCY YARN SPINNING SYSTEM

(71) Applicant: SANKO TEKSTIL ISLETMELERI SANAYI VE TICARET ANONIM SIRKETI, Gaziantep (TR)

(72) Inventors: Ahmet Gökhan Aydin, Gaziantep (TR); Hakan Konukoglu, Gaziantep (TR)

(73) Assignee: SANKO TEKSTIL ISLETMELERI SANAYI VE TICARET ANONIM SIRKETI, Gaziantep (TR)

( * ) Notice: Subject to any disclaimer, the term of this patent is extended or adjusted under 35 U.S.C. 154(b) by 88 days.

(21) Appl. No.: 15/554,150

(22) PCT Filed: Mar. 10, 2016

(86) PCT No.: PCT/TR2016/050066

§ 371 (c)(1),
(2) Date: Aug. 28, 2017

(87) PCT Pub. No.: WO2016/144280

PCT Pub. Date: Sep. 15, 2016

(65) Prior Publication Data

US 2018/0038018 A1 Feb. 8, 2018

(30) Foreign Application Priority Data

Mar. 11, 2015 (TR) ..... 2015 02910

(51) Int. Cl.
*D01H 4/34* (2006.01)
*D02G 1/00* (2006.01)
(Continued)

(52) U.S. Cl.
CPC ..... *D02G 1/008* (2013.01); *D01H 5/00* (2013.01); *D02G 3/34* (2013.01); *D01H 13/16* (2013.01)

(58) Field of Classification Search
CPC ..... D01H 4/02; D01H 4/34; B65H 63/036
See application file for complete search history.

(56) References Cited

U.S. PATENT DOCUMENTS 4,107,911 A * 8/1978 Yamana ..... D01H 1/115 57/304
4,450,675 A * 5/1984 Petrov ..... D02G 3/343 57/12

(Continued)

FOREIGN PATENT DOCUMENTS

CN 103266374 A 8/2013
EP 1184495 A2 3/2002

OTHER PUBLICATIONS

International Search Report for corresponding International Application No. PCT/TR2016/050066.

*Primary Examiner* — Tajash D Patel
(74) *Attorney, Agent, or Firm* — Bayramoglu Law Offices LLC

(57) ABSTRACT

A yarn spinning system has a sliver feeding part feeding a main material used for yarn formation; a main spinning unit in which the spinning procedure of the main materials is performed; suction pipes present in the main spinning unit and enabling the intake of waste fiber formed during spinning; the draft cylinders enabling orderly drawing and smoothing of the main material (fiber) fed into the system; additionally to provide conveying the injected yarns fed into the system to a draft area through the yarn feeding path; and enabling fancy yarn production by conveying the injected yarns to the main spinning unit by being centered on the main material via the yarn guide.

4 Claims, 1 Drawing Sheet

(51) Int. Cl.

| | |
|---|---|
| ***D02G 3/34*** | (2006.01) |
| ***D01H 5/00*** | (2006.01) |
| *D01H 13/16* | (2006.01) |

(56) References Cited

U.S. PATENT DOCUMENTS

| | | | | | |
|---|---|---|---|---|---|
| 5,170,619 | A * | 12/1992 | Noda | D01H 1/115 | 57/328 |
| 5,333,354 | A * | 8/1994 | Takemoto | D04B 35/32 | 15/301 |
| 5,423,170 | A * | 6/1995 | Dammann | B65H 54/34 | 15/301 |
| 5,531,391 | A * | 7/1996 | Yamamoto | B65H 54/702 | 242/475.1 |
| 5,862,660 | A * | 1/1999 | Haasen | B65H 63/06 | 242/475.1 |
| 6,308,507 | B1 * | 10/2001 | Dinkelmann | D01H 4/38 | 57/328 |
| 6,370,858 | B1 * | 4/2002 | Mori | D01H 1/115 | 57/12 |
| 8,850,784 | B2 * | 10/2014 | Ke | D02G 1/02 | 57/58.49 |
| 2002/0139102 | A1 | 10/2002 | Kawabata | | |
| 2014/0283496 | A1 * | 9/2014 | Stahlecker | D01H 4/48 | 57/263 |

* cited by examiner

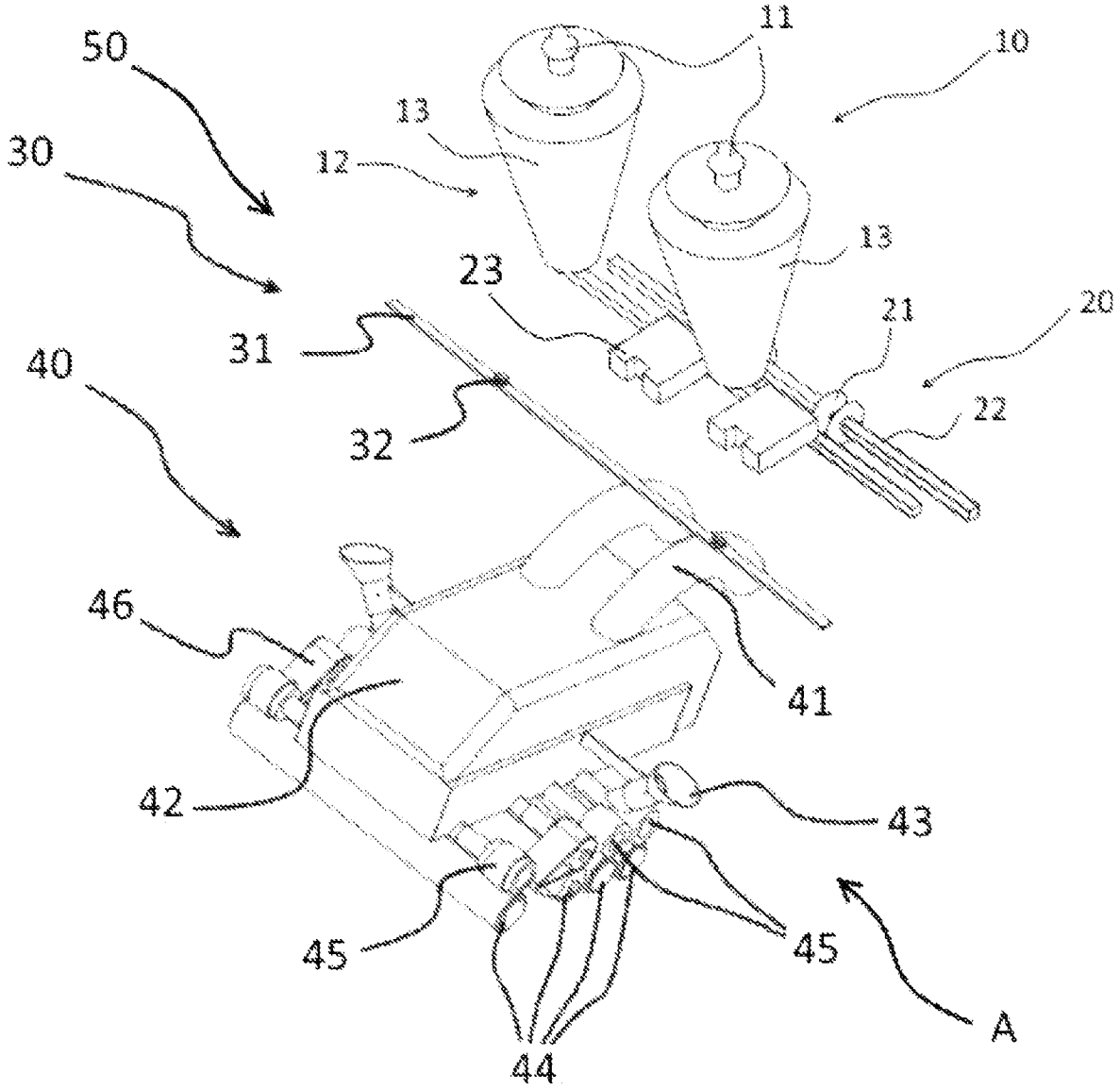
50
30
40
31
32
23
12
13
11
10
13
21
20
22
46
42
41
43
45
45
44
A

AIR-JET FANCY YARN SPINNING SYSTEM

TECHNICAL FIELD

The invention relates to an air-jet yarn spinning system enabling making yarns by spinning fibres.

The invention particularly relates to an air-jet yarn spinning system enabling fancy yarn production by feeding injected yarn to the air-jet yarn spinning system.

PRIOR ART

Currently, ring yarn machines are used to render staple fibres to yarns. Ring yarn machines enable yarn formation by combining fibres by twisting in a direction (clockwise or counter-clockwise) determined by the spinning method. Said ring yarn machine is among classical spinning methods.

Other spinning methods are:

Rotor yarn spinning,

Friction spinning,

Air-jet spinning,

Wound yarn spinning methods.

Air-jet spinning is a system in which a part of fibers fed with air provided in reverse direction of fiber dispatch is fed into yarn center and the other part is combined by twisting around the center of the fiber.

In our day, fancy yarns are also used to provide a difference appearance to fabrics produced in many different fields. Areas of utilization for fancy yarn are as follows:

Initially, fancy yarns existed in wool weaving factories as weft yarn to be used in male/female outerwear. Today, fashion designers use fancy yarn as a fashion element in woven and knitted fabrics in particularly outwears. These may be used in fabrics of products such as jacket, trousers, skirt, blouse and dress as well as in male/female outwears such as knitting-derived dress, blouse, knitted scarf etc., and used areas are enhancing day by day.

Said fancy yarn is produced by feeding of two separate yarns to each other at different speeds. Or, they may be formed with different twisting methods in twisting machines. It is possible to produce fancy yarns also called as shantung and/or injected yarn in ring and (from other spinning methods) rotor-open end yarn machines. Fancy yarns produced in these machines cannot provide some desired results in terms of shantung thickness and length. Moreover, the fancy yarns produced in said ring yarn machines cannot incorporate some important features such as low pilling (anti-pilling), high paint affinity and high gloss.

Said yarn spinning machines used in prior art are only used in straight yarn production and no attempt is made relating to fancy yarn production.

In the prior art, uniform yarn production was performed in the air-jet spinning machines which limited product diversity.

In the prior art, a different machine was required for rendering the yarn produced in the air-jet spinning machine to the fancy yarn. Thus, extra labor and cost arose. In addition, the inability to perform all these procedures in a single machine affected production period negatively.

In the prior art, for combination of two different yarns for fancy yarn production, factories producing these different yarns had to agree and sale of the required yarns had to be performed. Marketing, transport etc. procedures arising during these procedures caused disadvantage in terms of time and cost.

In the prior art, the yarns used for the production of fancy yarn were subjected to a two-stage procedure as first production and transformation stage for fancy yarn. This caused extra piling of the produced yarns due to the friction. Lowness of these features affects yarn quality directly. Low quality of the yarn causes negative results in many areas from low sale price to quality of the produced fabric.

As a result of studies performed in the literatures, some embodiments relating to said yarn spinning are encountered. One of these is a utility model with application number TR2010/06821 titled "A yarn spinning unit equipped with fiber guide member". The abstract of this application states: "This invention relates to a yarn spinning unit of an air-jet yarn spinning machine comprising a fiber guide member. It is suggested that feeding direction of the fiber band inclines with an inclination angle (a) in direction of fiber guiding surface and the inlet edge is positioned inside the fiber guiding member in order to increase the expansion in edge fibers of fiber band fed into the system and thus to improve yarn quality and also to prevent the accumulation of fiber members in a position in parallel with feeding direction".

In said application above, the air-jet yarn spinning machine having a method in which fibres are twisted and turned into yarns is mentioned. Although many example can be seen as such, production of fancy yarn in the air-jet yarn spinning machines is not encountered anywhere. Hence, this application may be shown as an example for said disadvantages above.

Consequently, air-jet yarn spinning machines are developed in parallel with developing technology, thereby eliminating the disadvantages mentioned above, and new structures are required for providing solutions to the existing systems.

AIM OF THE INVENTION

The invention relates to an air-jet yarn spinning system formed by inspiration from the present situations, developed to solve said disadvantages and providing some additional advantages.

Aim of the invention is to realize fancy yarn production in the air-jet yarn spinning machines. Thus, fancy yarns are produced without a need for the use of two separate machines and thereby minimizing production cost and labor costs.

Another aim of the invention is to produce shorter shantung yarns compared to the present ones by making the fancy yarn production in the -jet spinning machine. It is also to reduce piling caused by friction by performing the fancy yarn production in a single machine.

Another aim of the invention is to cause the yarn to have functional features such as low pilling (anti-pilling), high paint affinity and high gloss thanks to the fancy yarn production in the air-jet machines. Sale of the fancy yarns produced in this manner and the fabrics produced form these yarns are easy and highly profitable. Thus, profit return of the products will increase. These advantages are not only in favor of producers, but also for consumers by providing fabrics with high quality and long life.

The invention may be used in yarn spinning processes in a variety of functional features, and woven and knitted fabrics may be produced with different features and appearances with this special yarn subsequently produced.

In order to realize the aims above, an air-jet yarn spinning machine has been developed enabling fancy yarn production by feeding injected yarn to the air-jet yarn spinning system.

Characteristic features and all advantages of the invention will be obvious thanks to the following drawings and the detailed description written with reference to these drawings. Hence, evaluation should be performed considering these drawings and the detailed description.

BRIEF DESCRIPTION OF DRAWINGS TO HELP IN UNDERSTANDING OF THE INVENTION

FIG. 1 shows perspective view of the air-jet yarn spinning system of the invention.

| Reference Numbers | |
|---|---|
| 10. | Creel |
| 11. | Creel hanger |
| 12. | Bobbin |
| 13. | Injected yarn |
| 20. | Sliver feeding part |
| 21. | Sliver feeding guide |
| 22. | Sliver feeding bar |
| 23. | Sensor |
| 30. | Yarn feeding part |
| 31. | Yarn feeding bar |
| 32. | Yarn feeding path |
| 40. | Main spinning unit |
| 41. | Suction pipes |
| 42. | Cover |
| 43. | Yarn guide |
| 44. | Draft cylinders |
| 45. | Sleeves |
| 46. | Upper apron |
| 50. | Yarn spinning system |
| A. | Draft area |

The drawings do not necessarily be scaled and unnecessary elements to understand the invention may be ignored. In addition, the elements with at least substantially the same or having at least substantially functions are shown with the same number.

DETAILED DESCRIPTION OF THE INVENTION

In this detailed description, preferred embodiments of the yarn spinning system (50) of the invention are explained for better understanding of the subject and not causing any limiting effect.

The main material used for yarn formation is fed into the system via sliver feeding part (20). The draft area (A) and the suction areas are within the main spinning unit (40). The suction pipes (41) in said main spinning unit (40) enable the intake of waste fiber formed during the spinning. Orderly drawing and smoothing of the main material (fiber) fed into the system is carried out with the draft cylinders (44). Said components constituted the yarn spinning system (50). The injected yarns (13) to be fed into said main spinning unit (40) are wound around the bobbins (12). Tension of said injected yarns (13) is enabled with the yarn feeding bar (31). The injected yarn (13) is conveyed to the draft area (A) through the yarn feeding path (32) on the yarn feeding bar (31). Said yarn spinning system (50) comprises the yarn guide (43) providing the conveyance of the injected yarns (13) to the main spinning unit (40) by being centered on the main material.

Structure Principle is as Follows:

FIG. 1 is perspective view of the empty situation of the air-jet yarn production system (50) of the invention.

Said yarn spinning system (50) consists of the creel (10), the sliver feeding part (20), the yarn feeding part (30), the main spinning unit (40) parts.

Said creel (10) consists of the creel hanger (11), the bobbin (12) and the injected yarns (13). The injected yarns (13) are wound to the bobbins (12), in turn the bobbins (12) are hung on the creel hangers (11). The injected yarns (13) are wound around the bobbins. Said injected yarns (13) are yarn having different features such as color, structure etc. in accordance with the fancy yarn type to be produced.

The main material to be subjected to the spinning procedure is a group of fibers as short fibres. This main material will be turned into yarn via the spinning procedure.

The sliver feeding part (20) is the part into which fibers in sliver form as the main material subjected to the spinning procedure are fed. The fibers here are conveyed into the system by passing through the sliver feeding guides (21) mounted on the sliver feeding bar (22).

The yarn feeding part (30) is the part into which the injected yarns (13) to provide fancy yarn appearance are fed. This part consists of the yarn feeding bar (31) and the yarn feeding path (32).

Lastly, the main spinning unit (40) in which the spinning procedure is performed consists of the suction pipes (41), the cover (42), the yarn guide (43), the draft cylinders (44), the sleeves (45) and upper apron (46) components. Said suction pipe (41) is the component enabling the intake of the waster fiber formed during the spinning.

The cover (42) is used to prevent situations such as impact etc. coming to this section from outside and to provide a cleaning working environment by covering the main spinning unit (40).

The yarn guide (43) is the guide components enabling complete centering of the fed injected yarns (13) on the main material.

The draft cylinders (44) as another component enable drawing, smoothing and thinning of the fiber orderly. The sleeves (45) positioned on said draft cylinders (44) enables a proper fiber draft by putting pressure on the fiber.

There is the upper apron (46) on the last part of the main spinning unit (40). Said upper apron (46) enabled the dispatch to the other parts in which fibers are twisted.

Assembly Principle is as Follows:

The main spinning unit (40) is positioned on upper part of the yarn spinning machine. 4 draft cylinders (44) are lined to the lower portion of the main spinning unit (40) side by side with predetermined intervals. The sleeves (45) are placed on upper portion of each draft cylinder (44). Said draft cylinders (44) and the sleeves (45) constitute the draft area (A). The upper apron (46) is put on the $3^{rd}$ draft cylinder (44) from the start and the sleeve (45) thereby enabling orderly dispatch of the fibers.

The cover (42) is positioned on said components, thus enabling the realization of the spinning procedure in a covered environment. The suction pipes (41) are mounted on the cover (42), thereby providing the connection of the cover with the inner portion of the main spinning unit (40).

The creel (10) system is arranged on upper side of the system. The creel (10) system is mounted such that there are two creel hangers (11) on the top of each main spinning unit (40). The bobbins (12) to which the injected yarns (13) are wound are hung to these creel hangers (11). The yarn feeding part (30) is positioned to the front side of the creel (10).

The main spinning unit (40) also comprises the yarn guides (43) by which the injected yarns (13) are to be incorporated to the system. Said yarn guides (43) are placed on the top of the draft cylinders (44). Moreover, sensor (23)

is configured in the system, and the injected yarn (13) enabled the controlled feeding of the injected yarn (13) during the spinning by passing through the sensors (23). When the injected yarn (13) breaks and/or no yarn is left on the bobbin, the spinning box is stopped and a light is turned on and thusly, intervention of an operator is enabled.

Working Principle is as Follows:

The main material in sliver form in the yarn spinning system (50) mounted as described above is conveyed to the draft area (40) passing from the sliver feeding guide (21) on the sliver feeding bar (22).

The main material is prepared to enter into the main spinning unit (40) with draft and thinning procedures between the draft cylinders (44) and the sleeves (45).

As the main material is prepared as such, the injected yarns (13) in form of bobbins (12) to be injected (different number, color, material and/or yarns twisted using technologies) are placed on the creel hanger (11). Feeding to the yarn guide (43) is provided passing through the yarn feeding bar (31) and the yarn feeding path (32). The yarn feeding path (32) and the yarn feeding guide (43) are profoundly important in terms of working performance of the yarns and the appearance of the effect. These are crucial parts for the ability to make compatible centering (Compatible centering: feeding of the injected yarn (13) on the main material in accordance with desired effect shape). The injected yarn (13) is sent to the main spinning unit (40) with the main material with the aid of the sleeves (45) and the upper apron (46).

During all these stated processes, air-jet fancy yarns may be produced with the materials prepared by way of the feeding of different materials in desired ratios and desired appearance effects (depending on the efficacy of centering and dispatch guides) into the main material.

What is claimed is:

1. An air-jet yarn spinning system comprising: a sliver feeding part feeding a main material used for yarn formation, a main spinning unit in which spinning of said main material is performed, suction pipes present in said main spinning unit and enabling the intake of waste fiber formed during the spinning, draft cylinders enabling orderly drawing and smoothing of the main material fed into the air-jet yarn spinning system, bobbins onto which injected yarn to be fed into said main spinning unit is wound, a yarn feeding bar enabling tension of said injected yarn, wherein the yarn feeding bar is arranged adjacent to the suction pipes and the suction pipes are mounted on a cover, thereby providing a connection of the cover with an inner portion of the main spinning unit, a yarn feeding path on the yarn feeding bar and enabling conveyance of said injected yarn into a draft area, and a yarn guide enabling conveyance of said injected yarn to the main spinning unit by being centered on the main material.

2. The air-jet yarn spinning system according to claim 1, further comprising a creel hanger to which said bobbins are hung and a creel in which said creel hanger is configured.

3. The air-jet yarn spinning system according to claim 1, further comprising a sensor turning a light on by stopping a spinning box when the injected yarn breaks and/or no yarn is left on the bobbins, and thus enabling intervention of an operator.

4. A method of yarn production by an air-jet yarn spinning system comprising: a sliver feeding part feeding a main material used for yarn formation, a main spinning unit in which spinning of said main material is performed, suction pipes present in said main spinning unit and enabling the intake of waste fiber formed during the spinning, draft cylinders enabling orderly drawing and smoothing of the main material fed into the air jet yarn spinning system, placing injected yarn used in fancy yarn production to a creel by winding around bobbins, conveying the injected yarn from said bobbins to a draft area with a desired tension by a yarn feeding path on a yarn feeding bar, wherein the yarn feeding bar is arranged adjacent to the suction pipes and the suction pipes are mounted on a cover, thereby providing a connection of the cover with an inner portion of the main spinning unit, conveying said injected yarn to the main spinning unit for fancy yarn production by being fully centered on the main material via a yarn guide.

* * * * *